US011466457B2

(12) United States Patent
King et al.

(10) Patent No.: US 11,466,457 B2
(45) Date of Patent: Oct. 11, 2022

(54) REINFORCED NOTCHED SUB-PURLIN

(71) Applicant: Roof Hugger, LLC, Lutz, FL (US)

(72) Inventors: Brandon King, Lutz, FL (US); Dale Nelson, Odessa, FL (US)

(73) Assignee: ROOF HUGGER, LLC, Lutz, FL (US)

( * ) Notice: Subject to any disclaimer, the term of this patent is extended or adjusted under 35 U.S.C. 154(b) by 0 days.

(21) Appl. No.: 16/993,014

(22) Filed: Aug. 13, 2020

(65) Prior Publication Data

US 2021/0047834 A1 Feb. 18, 2021

Related U.S. Application Data

(60) Provisional application No. 62/886,176, filed on Aug. 13, 2019.

(51) Int. Cl.
*E04D 3/36* (2006.01)

(52) U.S. Cl.
CPC ..... *E04D 3/3608* (2013.01)

(58) Field of Classification Search
CPC ..... E04D 3/336; E04D 3/607; E04D 3/3608; E04C 3/065; E04C 2003/0482
See application file for complete search history.

(56) References Cited

U.S. PATENT DOCUMENTS 1,645,060 A * 10/1927 Kraft ..... E04C 3/09 52/634
2,446,323 A 8/1948 Davis et al.
2,887,192 A 5/1959 Schaub et al.
3,253,375 A 5/1966 Takehara
3,660,482 A 5/1972 Elizalde
3,820,295 A 6/1974 Folley
4,081,938 A 4/1978 Bertacchi et al.
4,245,446 A 1/1981 Judkins
(Continued)

FOREIGN PATENT DOCUMENTS

CA 2776409 A1 * 11/2012 ..... E04D 3/3608
EP 196182 10/1986
(Continued)

OTHER PUBLICATIONS

Examination Report for Australian Patent Application No. 2020213368, dated Apr. 15, 2021 11 pages.

*Primary Examiner* — Christine T Cajilig
(74) *Attorney, Agent, or Firm* — Sheridan Ross P.C.

(57) ABSTRACT

A reinforced notched sub-purlin is formed by a top flange, one or more vertical webs, one or more base flanges, one or more notches, and at least one reinforcement. The top flange extends the entire length of the reinforced notched sub-purlin. The vertical web(s) extend from the top flange, and the one or more notches are formed by removing a portion of the vertical web (where only one vertical web is used) or by separating adjacent vertical webs (where a plurality of vertical webs are used). A base flange extends from the vertical web(s) in a direction opposite the direction in which the top flange extends from the vertical web. The at least one reinforcement is provided on the vertical web(s) and provides enhanced stiffness, thus improving ability of the reinforced notched sub-purlin (and a roof or wall panel installed thereon) to resist forces resulting from, for example, wind and snow.

20 Claims, 7 Drawing Sheets

(56) References Cited

U.S. PATENT DOCUMENTS

| | | | | |
|---|---|---|---|---|
| 4,301,628 | A | 11/1981 | Lowe | |
| 4,346,543 | A | 8/1982 | Wilson et al. | |
| 4,400,924 | A | 8/1983 | Andrews | |
| 4,417,431 | A | 11/1983 | Commins et al. | |
| 4,476,921 | A | 10/1984 | Stubbolo | |
| 4,835,917 | A | 6/1989 | Simpson | |
| 4,894,967 | A * | 1/1990 | Morton | E04B 7/00 228/182 |
| 4,959,939 | A | 10/1990 | Buchanan, Jr. | |
| 5,088,259 | A | 2/1992 | Myers | |
| 5,242,523 | A | 9/1993 | Willden et al. | |
| 5,367,848 | A | 11/1994 | McConnohie | |
| 5,511,354 | A | 4/1996 | Eidson | |
| 5,857,292 | A | 1/1999 | Simpson | |
| 6,061,987 | A | 5/2000 | King | |
| 6,065,256 | A | 5/2000 | Joko et al. | |
| 6,112,482 | A | 9/2000 | Wright et al. | |
| 6,332,299 | B1 | 12/2001 | Stewart, III | |
| 6,415,581 | B1 * | 7/2002 | Shipman | E04C 2/322 52/537 |
| 6,811,852 | B2 | 11/2004 | Alderman | |
| 7,174,686 | B1 | 2/2007 | Legband | |
| 7,316,099 | B2 | 1/2008 | Faulkner et al. | |
| 7,493,729 | B1 | 2/2009 | Semmes | |
| 7,861,480 | B2 | 1/2011 | Wendelburg et al. | |
| 7,963,038 | B2 | 6/2011 | Schmitz | |
| 7,984,596 | B1 | 7/2011 | Simpson et al. | |
| 8,024,906 | B1 * | 9/2011 | Nelson | E04D 13/165 52/410 |
| 8,033,070 | B2 | 10/2011 | Morello et al. | |
| 8,104,247 | B2 | 1/2012 | Hasse | |
| 8,122,667 | B2 | 2/2012 | Ferge et al. | |
| 8,141,306 | B2 | 3/2012 | Masuda et al. | |
| 8,555,589 | B2 | 10/2013 | Semmens et al. | |
| 8,572,900 | B1 | 11/2013 | Potts | |
| 8,789,331 | B2 | 7/2014 | Bol | |
| 8,844,229 | B1 | 9/2014 | Hohmann, Jr. | |
| 8,991,111 | B1 | 3/2015 | Harkins | |
| 9,016,016 | B2 | 4/2015 | Den Adel | |
| 9,157,239 | B2 | 10/2015 | Allen et al. | |
| 9,499,987 | B2 | 11/2016 | Horton | |
| 9,789,948 | B2 | 10/2017 | Marin et al. | |
| 9,840,041 | B2 | 12/2017 | Hallander et al. | |
| 9,896,846 | B2 | 2/2018 | Horton | |
| 10,208,478 | B2 | 2/2019 | Horton | |
| 10,323,416 | B2 | 6/2019 | Horton | |
| 10,815,657 | B2 * | 10/2020 | Hortom | E04B 1/61 |
| 2002/0112435 | A1 | 8/2002 | Hartman | |
| 2004/0003565 | A1 | 1/2004 | Konopka | |
| 2005/0005549 | A1 | 1/2005 | Peter et al. | |
| 2006/0150536 | A1 | 7/2006 | Smith | |
| 2007/0256381 | A1 | 11/2007 | Foote, Jr. | |
| 2007/0283657 | A1 | 12/2007 | Pratt | |
| 2009/0094926 | A1 | 4/2009 | Richmond | |
| 2011/0146199 | A1 | 6/2011 | Ferrante et al. | |
| 2011/0247298 | A1 * | 10/2011 | Stal | E04C 3/07 52/846 |
| 2012/0291382 | A1 | 11/2012 | Bussell | |
| 2017/0342714 | A1 * | 11/2017 | Babcock | E04D 3/362 |
| 2018/0073242 | A1 * | 3/2018 | Hortom | E04D 3/3607 |
| 2020/0407971 | A1 | 12/2020 | Hortom | |

FOREIGN PATENT DOCUMENTS

| | | | | |
|---|---|---|---|---|
| EP | 822300 | | 2/1998 | |
| EP | 2628870 | A1 * | 8/2013 | E04D 3/3608 |
| GB | 2276644 | | 10/1994 | |
| NZ | 578392 | | 2/2011 | |

* cited by examiner

REINFORCED NOTCHED SUB-PURLIN

CROSS REFERENCE TO RELATED APPLICATIONS

This application claims the benefit of U.S. Provisional Application No. 62/886,176, filed on Aug. 13, 2019, which application is incorporated herein by reference in its entirety.

FIELD OF THE DISCLOSURE

The present disclosure relates to equipment for retrofitting roofs, and more particularly to devices for securing a new metal roof on top of a pre-existing metal roof.

BACKGROUND

Sub-purlins attach to existing building roof purlins to allow replacements of roofs without removing the existing roof. Previous designs of sub-purlins included notches. For example, FIGS. 10 and 11 show a notched sub-purlin 1000. The notches 1016 of FIGS. 10 and 11 have five sides and fit over the ribs 1012 of an existing roof panel 1008.

U.S. Pat. No. 8,024,906 describes a notched sub-purlin for use in retrofitting metal-clad buildings to facilitate attachment of a new roof or wall panel over existing ribbed or fluted panels of various configurations.

SUMMARY

A notched sub-purlin according to embodiments of the present disclosure is reinforced. Although notched sub-purlins as shown in FIGS. 10 and 11 have been available for many years, such sub-purlins have never been reinforced as described herein. More specifically, one or more reinforcements may be added to a vertical web of the notched sub-purlin. The reinforced notched sub-purlin may be attached through an existing roof or wall panel and into the underlying structure, and one or more new roof or wall panels may be attached to the sub-purlin. The addition of one or more reinforcements provides the notched sub-purlin with increased stiffness and resistance to stress and strain. The use of reinforced notched sub-purlins may allow a new metal roof or wall panel installed thereon to achieve tested strength up to the full positive and negative test values that, due to a lack of stiffness, current sub-purlins typically do not allow the new panel to achieve. This may help to preserve the structural integrity of the roof or wall in the face of harsh conditions (e.g., strong winds, heavy loads).

According to one embodiment, a reinforced notched sub-purlin may contain a top flange, one or more vertical webs, one or more base flanges, one or more notches, and one or more reinforcements. The one or more vertical webs may extend substantially perpendicularly from one side of the top flange, and may be integral with the top flange. The one or more base flanges may extend substantially perpendicularly from the one or more vertical webs, on a side of the one or more vertical webs distal from the top flange. The one or more base flanges may also be integral with the one or more vertical webs, and may be substantially parallel with the top flange.

The one or more notches may be provided in the vertical web, or, in embodiments with a plurality of vertical webs, the one or more notches may be provided in between the vertical webs. Notches may have a variety of shapes including, but not limited to, trapezoidal, circular, rectangular, and polygonal. The shape of the notch may be selected depending on the shape of the ribs of the panels of an existing roof, and the notches may be shaped to receive the ribs of existing roof panels. The one or more base flanges may be utilized to attach the reinforced notched sub-purlin to the existing roof panel and underlying structure. The top flange may be utilized to attach a new roof panel to the reinforced notched sub-purlin. In some embodiments, one or both of the top flange and the vertical web may be utilized to attach the reinforced notched sub-purlin to the existing panel and underlying structure. The reinforced notched sub-purlin may also have one or more anti-rotational arms integral with or attached to the vertical web, each of which may protrude into an adjacent notch, and each of which may be bent during installation of the reinforced sub-purlin to extend along a rib received by the notch. Once so bent, the anti-rotational arm may be used to attach to the rib of the existing roof panel and underlying structure.

A reinforced notched sub-purlin may be attached over an existing roof panel, and the attachment area may be directly above an original purlin. The sub-roofing system may provide ventilation. The reinforced notched sub-purlin may be required to withstand forces resulting from wind, snow, and other natural phenomena that can impose significant loads on a roof. The reinforcement may provide additional strength to prevent damage caused by such natural phenomena.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together. When each one of A, B, and C in the above expressions refers to an element, such as X, Y, and Z, or class of elements, such as $X_1$-$X_n$, $Y_1$-$Y_m$, and $Z_1$-$Z_0$, the phrase is intended to refer to a single element selected from X, Y, and Z, a combination of elements selected from the same class (e.g., $X_1$ and $X_2$) as well as a combination of elements selected from two or more classes (e.g., $Y_1$ and $Z_0$).

The term "a" or "an" entity refers to one or more of that entity. As such, the terms "a" (or "an"), "one or more" and "at least one" can be used interchangeably herein. It is also to be noted that the terms "comprising", "including", and "having" can be used interchangeably.

The preceding is a simplified summary of the disclosure to provide an understanding of some aspects of the disclosure. This summary is neither an extensive nor exhaustive overview of the disclosure and its various aspects, embodiments, and configurations. It is intended neither to identify key or critical elements of the disclosure nor to delineate the scope of the disclosure but to present selected concepts of the disclosure in a simplified form as an introduction to the more detailed description presented below. As will be appreciated, other aspects, embodiments, and configurations of the disclosure are possible utilizing, alone or in combination, one or more of the features set forth above or described in detail below.

BRIEF DESCRIPTION OF THE DRAWINGS

The accompanying drawings are incorporated into and form a part of the specification to illustrate several examples of the present disclosure. These drawings, together with the description, explain the principles of the disclosure. The drawings simply illustrate preferred and alternative examples of how the disclosure can be made and used and are not to be construed as limiting the disclosure to only the illustrated and described examples. Further features and advantages will become apparent from the following, more detailed, description of the various aspects, embodiments, and configurations of the disclosure, as illustrated by the drawings referenced below.

DETAILED DESCRIPTION

Figure 1:
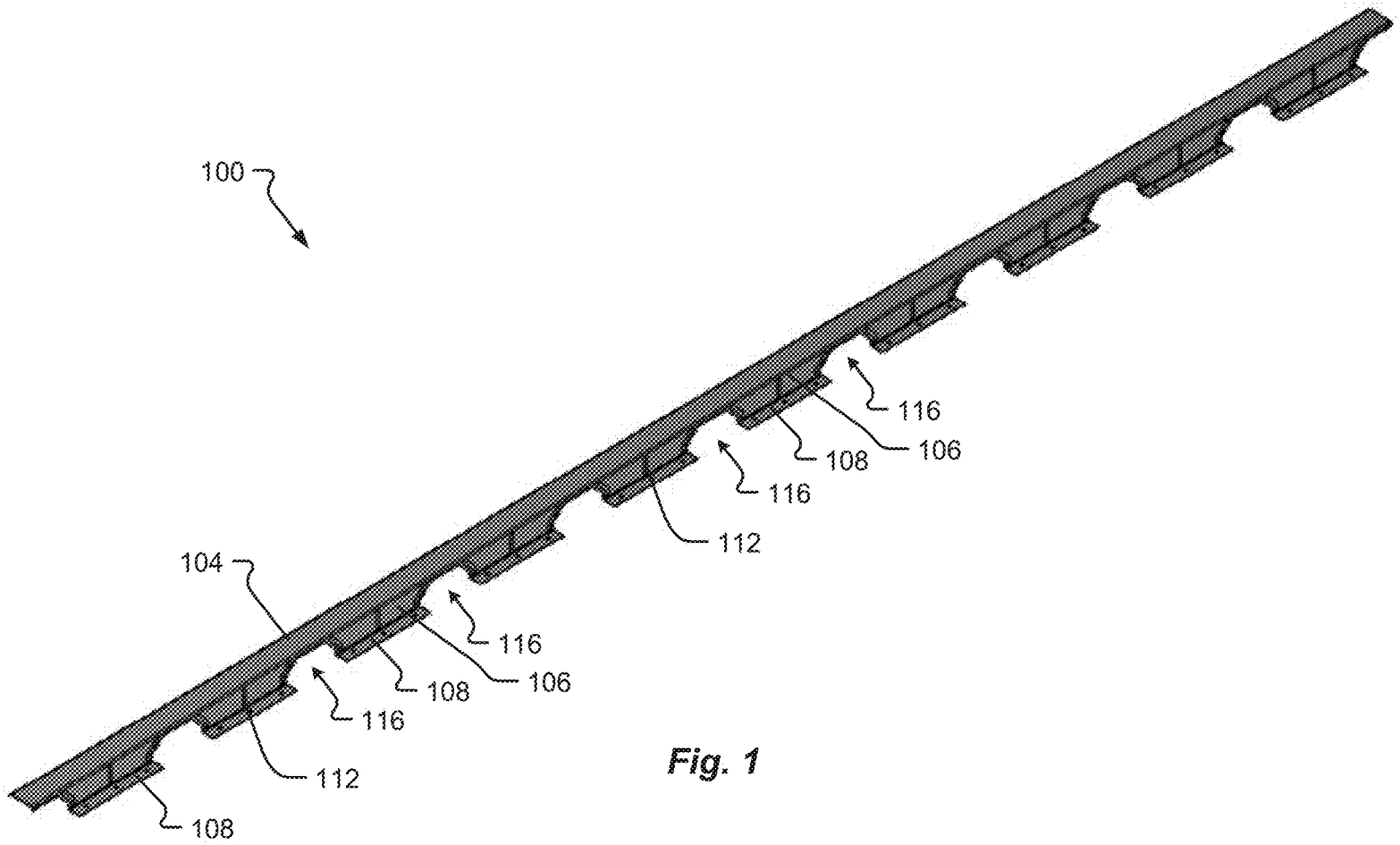
FIG. 1 shows a perspective view of a reinforced notched sub-purlin according to embodiments of the present disclosure.
Figure 3:
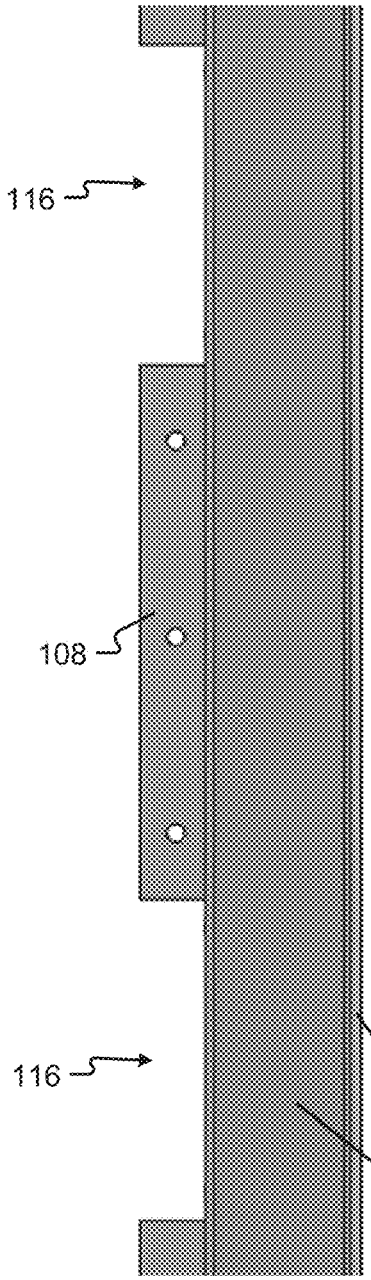
FIG. 3 shows a detailed view of Area A of FIG. 2 of a reinforced notched sub-purlin according to embodiments of the present disclosure.
Figure 2:
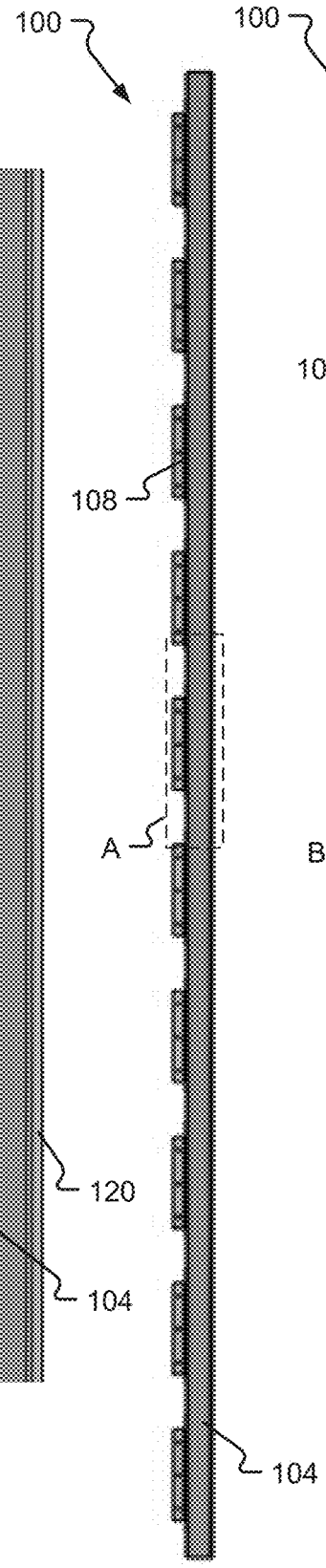
FIG. 2 shows a top view of a reinforced notched sub-purlin according to embodiments of the present disclosure.
Figure 4:
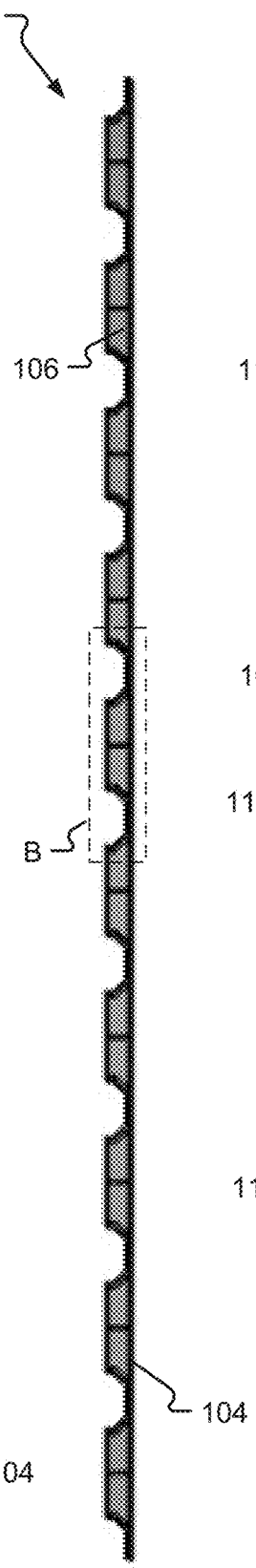
FIG. 4 shows a side view of a reinforced notched sub-purlin according to embodiments of the present disclosure.
Figure 5:
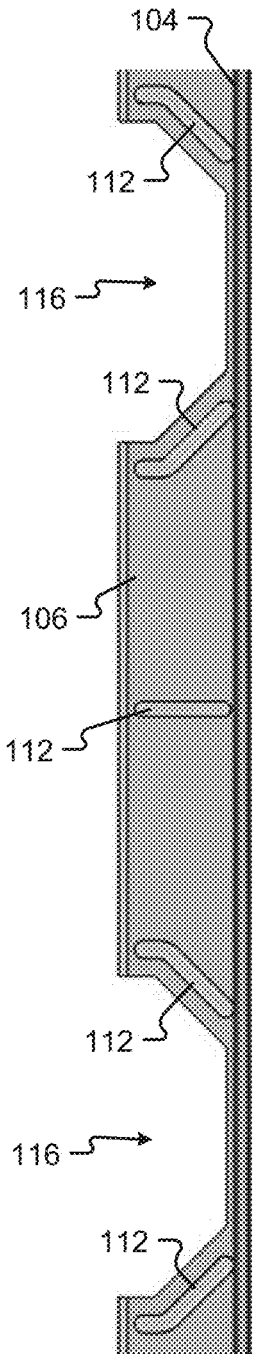
FIG. 5 shows a detailed view of Area B of FIG. 4 of a reinforced notched sub-purlin according to embodiments of the present disclosure.

Before any embodiments of the disclosure are explained in detail, it is to be understood that the disclosure is not limited in its application to the details of construction and the arrangement of components set forth in the following description or illustrated in the drawings. The disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Further, the present disclosure may use examples to illustrate one or more aspects thereof. Unless explicitly stated otherwise, the use or listing of one or more examples (which may be denoted by "for example," "by way of example," "e.g.," "such as," or similar language) is not intended to and does not limit the scope of the present disclosure.

With reference to FIGS. 1-8, a reinforced notched sub-purlin 100 for use in embodiments of the present disclosure may comprise, for example, a top flange 104, one or more notches 116, one or more base flanges 108, a vertical web 106, and a reinforcement 112.

The top flange 104 may extend along the entirety of the reinforced notched sub-purlin 100. The length of the notched reinforced sub-purlin (and thus of the top flange 104) may be selected based on the dimensions of an existing roof on which the reinforced notched sub-purlin 100 will be installed. In some embodiments, the top flange 104 may be sized to be half the length or width of an existing roof, or less than half the length or width of an existing roof. The width of the top flange 104 may be selected based on one or more characteristics of an existing roof on which the reinforced notched sub-purlin 100 will be installed, and/or based on one or more characteristics of a new roof that will be secured to the reinforced notched sub-purlin 100.

The top flange 104 provides a surface to which new roof panels may be attached. In some embodiments, one or more roofing materials such as insulation, fiberglass, and/or ventilation may also be attached to the top flange 104. The top flange 104 may be installed up slope to the existing roof. In some embodiments, the top flange 104 may be attached to the top of an existing panel by one or more mechanical fasteners, which may pass through the top flange 104 and into, for example, one or more ribs of an existing roof panel.

The top flange 104 is connected to the one or more vertical webs 106 along one edge of the top flange 104. The top flange 104 and the one or more vertical webs 106 may be of integral construction (e.g., fashioned of a single piece of material), or the top flange 104 may be fashioned separately from the vertical webs 106 and secured thereto via welding or otherwise.

Figure 6:
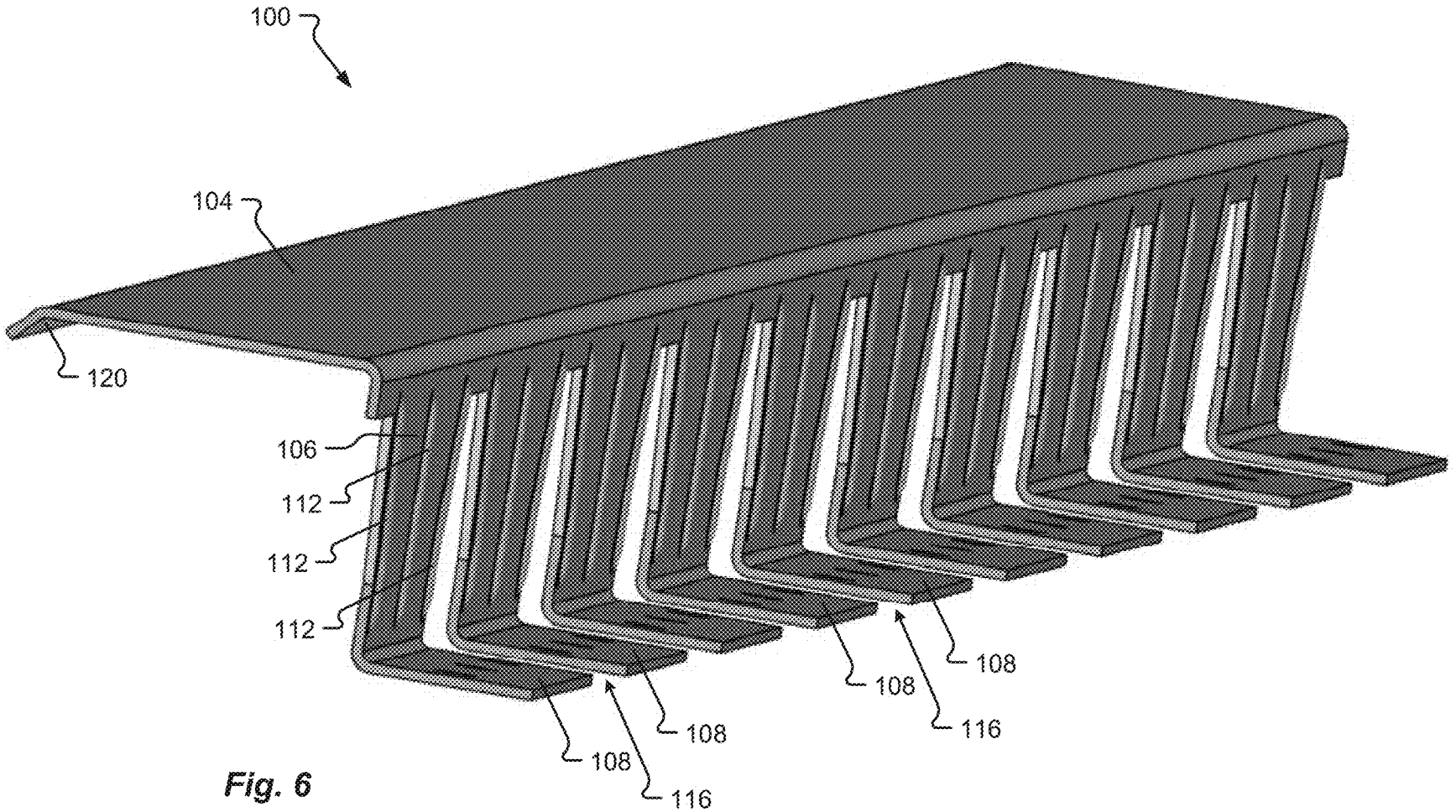
FIG. 6 shows a perspective view of a reinforced notched sub-purlin according to embodiments of the present disclosure.
Figure 7:
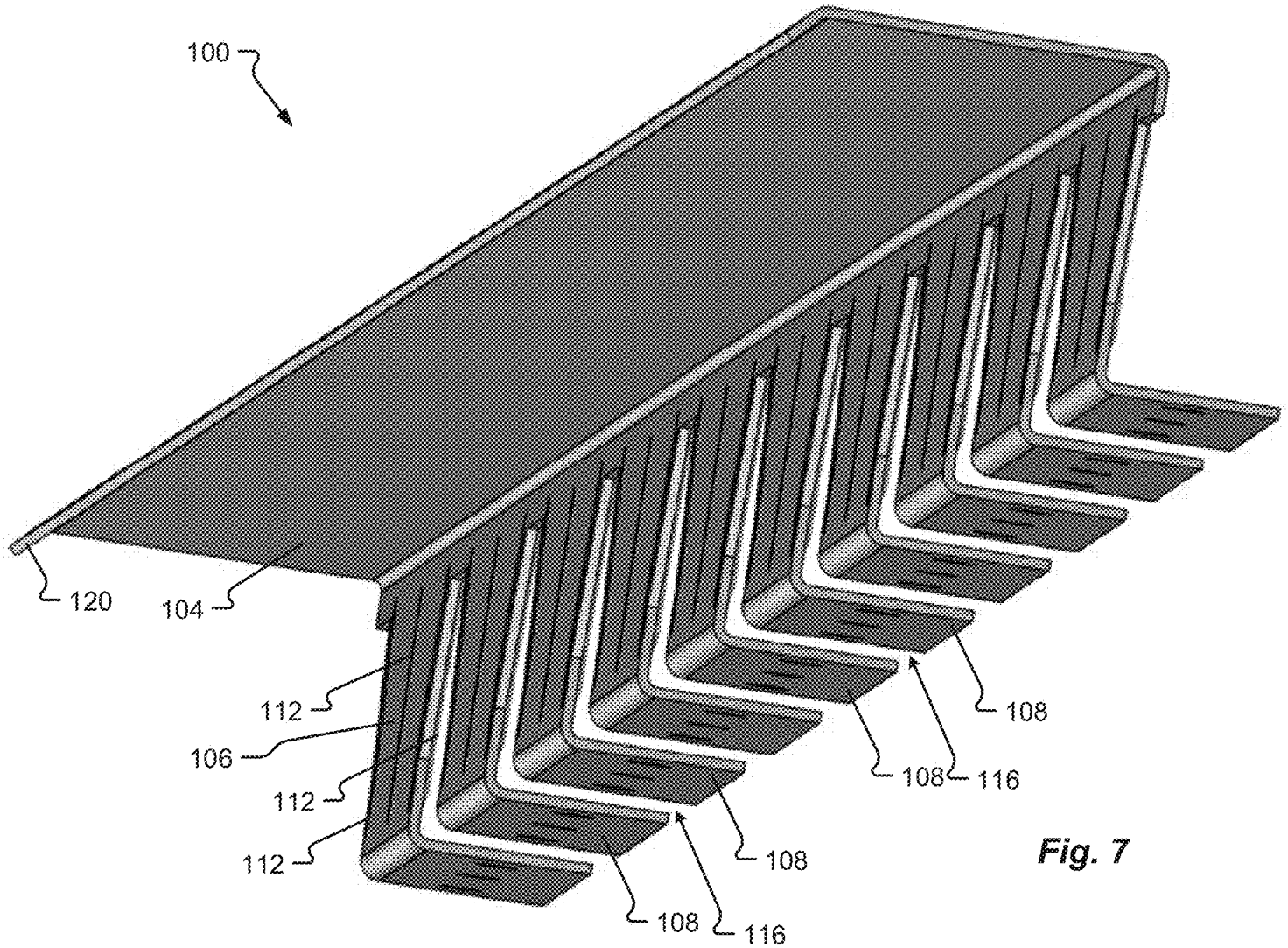
FIG. 7 shows an isometric view of a reinforced notched sub-purlin according to embodiments of the present disclosure.
Figure 8:
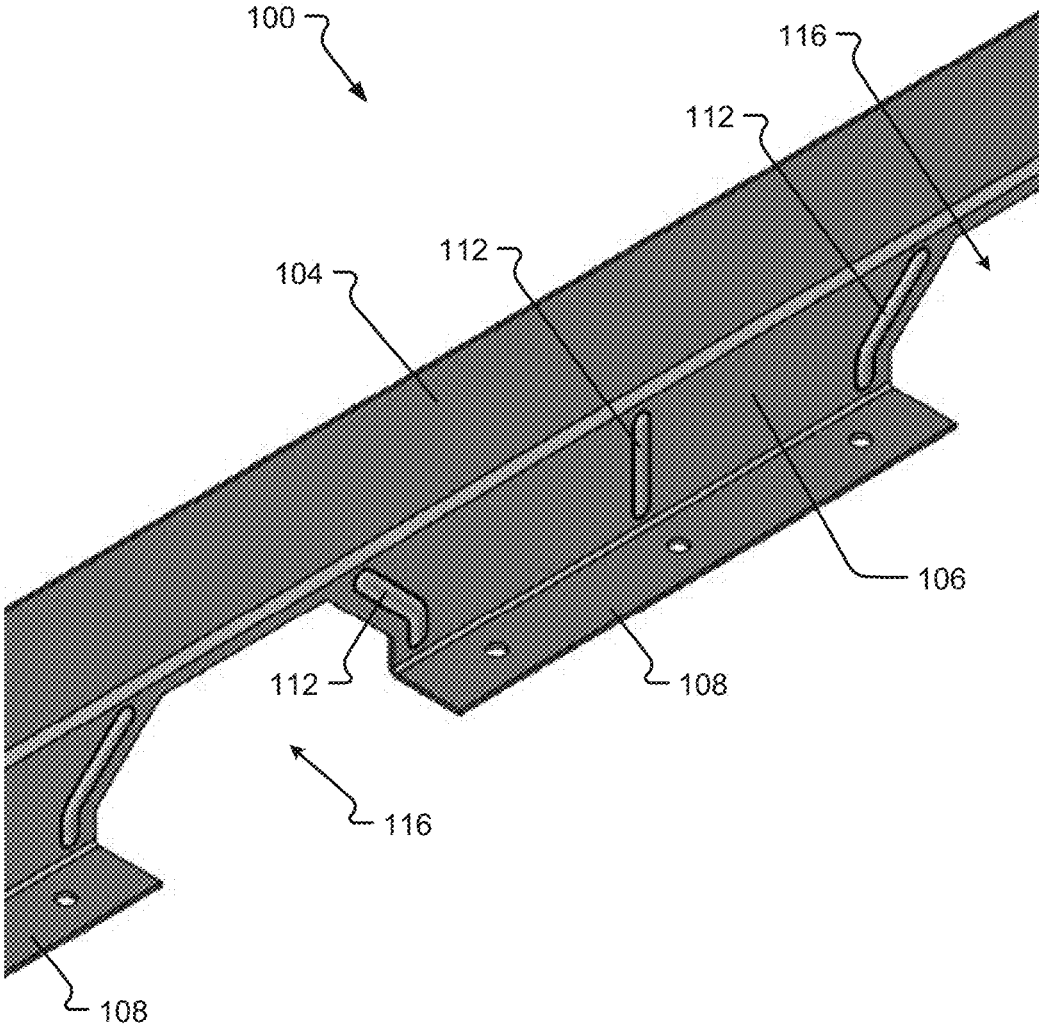
FIG. 8 shows a detailed view of a reinforced notched sub-purlin according to embodiments of the present disclosure.

As shown in FIG. 6, the top flange 104 has a first side from which the one or more vertical webs 106 extend, and a second side opposite the first side from which a stiffening lip 120 extends. The stiffening lip 120 may stiffen the top flange 104 against bending and torsion.

In some embodiments, the top flange 104 may define an upper boundary of each notch 116, and may additionally either touch or be positioned proximate a rib of a previously installed roof panel. In other embodiments, the vertical web 106 may extend along an entire length of the reinforced notched sub-purlin 100, such that the upper boundary of each notch 116 is defined only by the vertical web 106.

As described previously, the vertical web 106 may extend substantially perpendicularly from one edge of the top flange 104. The width and height of the vertical web 106 may be selected depending on one or more characteristics of a pre-existing roof on which the reinforced notched sub-purlin 100 will be installed and/or depending on one or more characteristics of a new roof that will be attached to the reinforced notched sub-purlin 100. In some embodiments, the vertical web 106 may be taller (in a dimension substantially perpendicular to the top flange 104) to accommodate roofing materials or systems, including but not limited to fiberglass, insulation, ventilation sheeting, photovoltaic panels, and other sheeting or systems. In some embodiments, each vertical web 106 may have a varying height (e.g., to accommodate a pre-existing roof profile). Also in some embodiments, the one or more vertical webs 106 may have a sufficient height to eliminate steps in the pre-existing roof.

When the reinforced notched sub-purlin 100 is installed, the vertical web 106 may come in contact with insulation, fiberglass, ventilation, and/or other roofing materials. The edges of the vertical web 106 may fully or partially contact the ribs of an existing roof panel on which the sub-purlin 100 is installed. Similarly, the bottom of the vertical web 106 may fully or partially contact the existing roof panel. The vertical web 106 may be attached to the rib or to other areas of the existing roof panel with one or more fasteners.

Adjacent vertical webs 106 may be separated from each other by a notch 116. Alternatively, a plurality of notches 116 may be provided at regular intervals along a single vertical web 106. The notches 116 may be formed by cutting, stamping, molding, shaping, or otherwise. In some embodiments, and depending on the shape of the notches 116, a longitudinal distance between each vertical web 106 may vary with distance from the top flange 104.

In some embodiments, the one or more notches 116 may not be equally spaced in a vertical web 106 (or a plurality of vertical webs 106 may have different lengths). The shape of each notch 116 may be defined at least in part by the edges of adjacent vertical webs 116, or the shape of each notch 116 may define in part the edge of a single vertical web 106. One or more edges of the notch 116 (and thus of the vertical web(s) 106 that define the notch 116) may be straight or curved. The notches 116 need not be symmetrical. In embodiments of the present disclosure comprising a plurality of vertical webs 106, the vertical webs 106 need not be symmetrical. In some embodiments, by way of example, one side of a notch 116 may be non-linear, while an opposite side of the notch 116 (in the longitudinal direction) may be straight. In another embodiment, a notch 116 may extend to a first distance from the top flange 116 on one side of the notch 116, while an opposite side of the notch 116 (in the longitudinal direction) may extend to a second distance from the top flange 104, the second distance different than the first distance. In still further embodiments, the edges on either side of a notch 116 may be both different heights (e.g., extend to different distances from the top flange 104) and different shapes.

The vertical web 106 may have a non-constant thickness due to the provision on the vertical web(s) 106 of one or more reinforcements 112. Reinforced areas of the vertical web(s) 106 may be thicker than areas of the vertical web(s) 106 that are not reinforced.

Each reinforcement 112 may comprise a pressed or stamped portion of the vertical web 106 that is displaced from the main surface of the vertical web 106. The reinforcements 112 may extend from the vertical web 106 in the same direction as the top flange 104, or the reinforcements 112 may extend from the vertical web 106 in an opposite direction from the top flange 104.

In some embodiments, the vertical web 106 may have one or more reinforcements 112 (comprising, for example, lengths of metal or other material that will increase the strength and/or stiffness of the vertical web 106) attached with epoxy or other adhesive methods. In further embodiments, one or more reinforcements 112 may be secured to the vertical web 106 by welding or other joining methods. In an embodiment, the vertical web 106 may be cut to create a reinforcement 112.

Each vertical web 106 may terminate in a base flange 108 that extends substantially perpendicularly from an edge of the vertical web that is opposite the edge of the vertical web 106 from which the top flange 104 extends. Each base flange 108 may be integral with (e.g., may be fashioned from the same piece of material as) the vertical web 106 from which it extends. In some embodiments, each base flange may be manufactured separately and joined to the vertical web(s) 106, whether by adhesive, welding, or otherwise.

The base flanges 108 may be provided with one or more holes to facilitate the use of a mechanical fastener to secure the reinforced notched sub-purlin 100 to an existing roof panel and underlying structure. For example, the base flanges 108 may each comprise 1, 2, 3, or 4 holes through which a nail, screw, or other fastener may be driven into a roof panel and underlying structure. In some embodiments, fewer than all of the holes may be used to secure each base flange 108 of a reinforced notched sub-purlin 100 to an existing roof. The number of holes in the base flanges 108 may depend on the length of the base flanges 108, with shorter base flanges 108 having fewer holes and longer base flanges 108 having more holes. In other embodiments, a different number of holes may be provided in each base flange 108.

The distance that each base flange 108 extends from the vertical web 106 may vary from one reinforced notched sub-purlin 100 to another, and may be determined based on one or more characteristics of a roof panel on which the reinforced notched sub-purlin 100 will be installed and/or based on one or more desired characteristics of the reinforced notched sub-purlin 100. The thickness of the base flanges 108 may be the same thickness as the vertical web(s) 106 and the top flange 104 (particularly where the top flange 104, the vertical web(s) 106, and the base flanges 108 are formed from a single sheet of metal or other material), or the base flanges 108 may have a greater or lesser thickness than the vertical web 106 and/or than the top flange 104. The distance that the base flanges 108 extend from the vertical web(s) 106 may be based on one or more characteristics of an existing roof to which the reinforced notched sub-purlin 100 will be secured (or for which the reinforced notched sub-purlin 100 is designed to be secured).

In embodiments having a plurality of vertical webs 106, a base flange 108 may extend from each vertical web 106. In embodiments having only a single vertical web 106, a base flange 108 may extend from the vertical web 106 adjacent each notch 116. In some embodiments, one or more of the base flanges 108 may have a different length than one or more others of the base flanges 108, and/or may contain a different number of holes than one or more others of the base flanges 108. When the reinforced notched sub-purlin 100 is installed on an existing roof panel, the base flange 108 may contact parts of the existing panel. However, the entirety of a given base flange 108 may not be in contact with the existing panel. Although FIGS. 1-8 show the base flange 108 with squared sides, the base flange 108 may be rounded, or may be formed with diagonal corners, or may be otherwise non-square. In an embodiment, the material used to create the base flange 108 may be flexible. The base flange 108 may contact roofing materials or systems, such as but not limited to, fiberglass, insulation, ventilation sheeting, photovoltaic panels, and other sheeting or systems.

The notches 116 provide a receptacle for ribs or other raised portions of an existing roof panel, and allow the base flanges 108 to extend to the surface of the panel in between such ribs or raised portions. The notches 116 may be different shapes. FIGS. 1-8 show the notches 116 with a partial octagonal shape to fit over an existing rib of a roof panel. In other embodiments, the notches 116 may have a circular, square, rectangular, oval, triangular, or hexagonal, shape; a shape with multiple edges and/or rounded edges; or any other shape configured to fit over the ribs or raised portions of an existing panel. In some embodiments, each of the plurality of notches 116 on one reinforced notched sub-purlin 100 may have a different shape and/or a different size, while in other embodiments, each of the plurality of notches 116 on one reinforced notched sub-purlin 100 may be the same shape and size. In some embodiments, the shapes and sizes of the notches 116 may be chosen to accommodate an existing roof panel with different shaped ribs across the roof panel.

The notches 116 may be created by stamping, punching, cutting, or otherwise. In some embodiments, the attachment of two vertical webs 106 to the top flange 104 may result in formation of a notch 116 therebetween. A reinforced notched sub-purlin 100 may contain a plurality of notches 116. The number of notches 116 may depend on the type of panel already existing on the roof (including, for example, the spacing of any ribs or other raised portions on the existing roof panel) and/or the length of the particular reinforced notched sub-purlin 100. The area of the notch 116 may fully or partially receive a rib of an existing roof panel. Thus, the edges of the vertical web(s) 106 may touch the rib of the existing roof panel at one or more of the points on the different sides of the notch 116. In some embodiments, the notch 116 may be sized and/or shaped so as to not fit closely around a rib, so as to allow ventilation from one side of the reinforced notched sub-purlin 100 to the other.

The reinforcements 112 may be formed in the vertical web(s) 106 by stamping, pressing, or otherwise. In some embodiments, the reinforcements 112 may be made by pressing a mold into the vertical web(s) 106. The reinforcements 112 may increase the stiffness and/or strength of the reinforced notched sub-purlin 100, and may increase the resistance of the reinforced notched sub-purlin to deformation under stress and/or strain. The reinforcements 112 may further aid in the prevention of fractures, cracks, and/or breakage of the reinforced notched sub-purlins 100. The reinforcements 112 may significantly improve the ability of the vertical web 106 to resist forces resulting from uplift wind loads and downward snows loads.

As shown in FIGS. 1-8, in some embodiments each vertical web 106 (or each portion of a vertical web 106 separated from another portion of the vertical web 106 by a notch 116) may comprise three reinforcements 112, with one reinforcement 112 positioned adjacent each edge of the vertical web 106 or portion thereof, and a third reinforcement 112 positioned approximately in between the first two reinforcements 112. In other embodiments, more or fewer reinforcements 112 may be utilized, and the position of the reinforcements 112 may be different than shown in FIGS. 1-8. In FIGS. 1-8, some of the reinforcements 112 have a bent shape (to follow the edge of the notches 116), while others of the reinforcements 112 are straight. In other embodiments, one or more reinforcements 112 may have the same or a similar shape as one or more of the reinforcements 112 in FIGS. 1-8, while one or more reinforcements 112 may have a different shape than any of the reinforcements shown in FIGS. 1-8. In some embodiments, the shape of the reinforcements 112 proximate the notches 116 may be determined based on the shape of the notches 116. For example, at least some reinforcements 112 may be shaped to follow the edges of the vertical web 106 that define the notches 116.

In addition to having different overall shapes, the reinforcements 112 may be longer or shorter, wider or narrower, thicker or thinner, larger or smaller. In some embodiments, the shape of the reinforcement 112 may not follow the shape of the edge of the vertical web 106.

Figure 9:
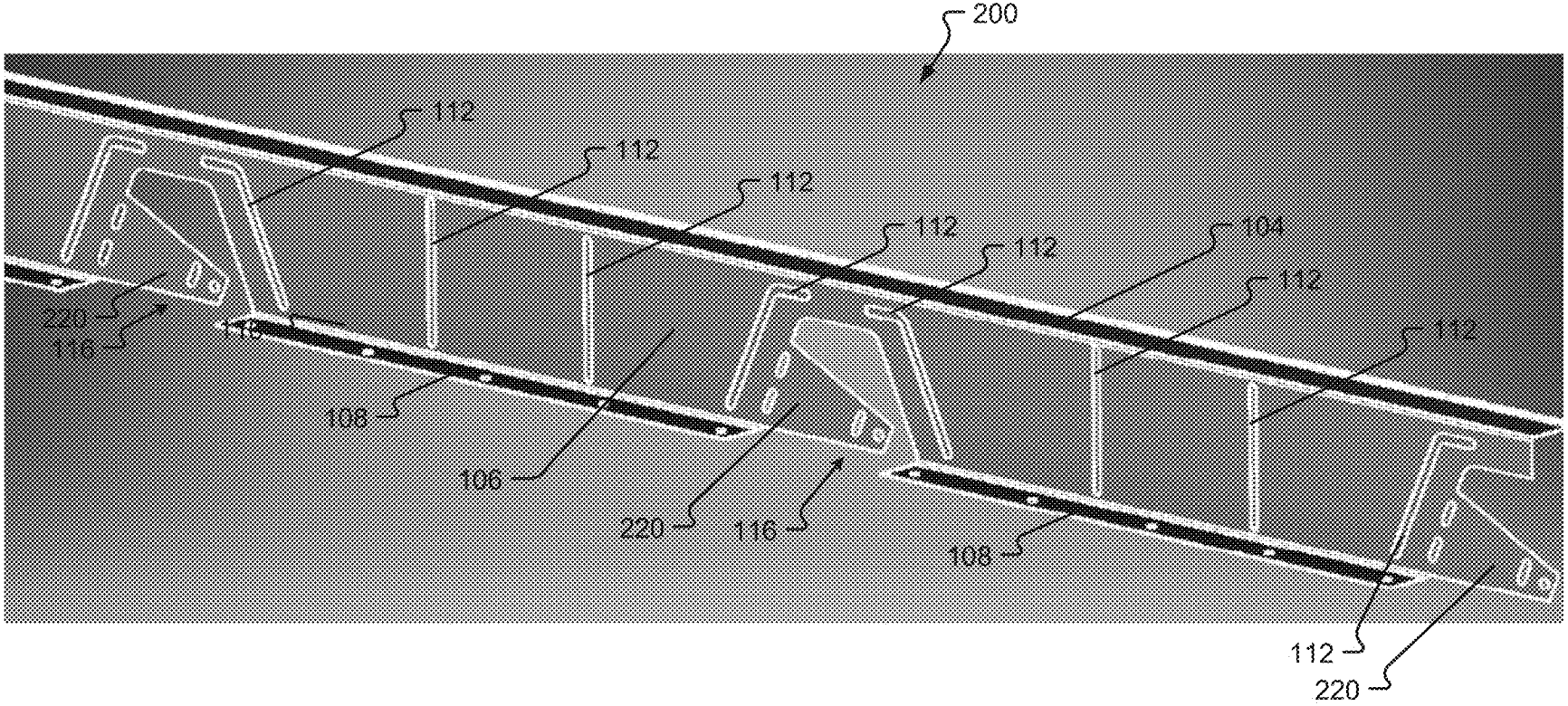
FIG. 9 shows a detailed view of a reinforced notched sub-purlin according to embodiments of the present disclosure.
Figure 10:
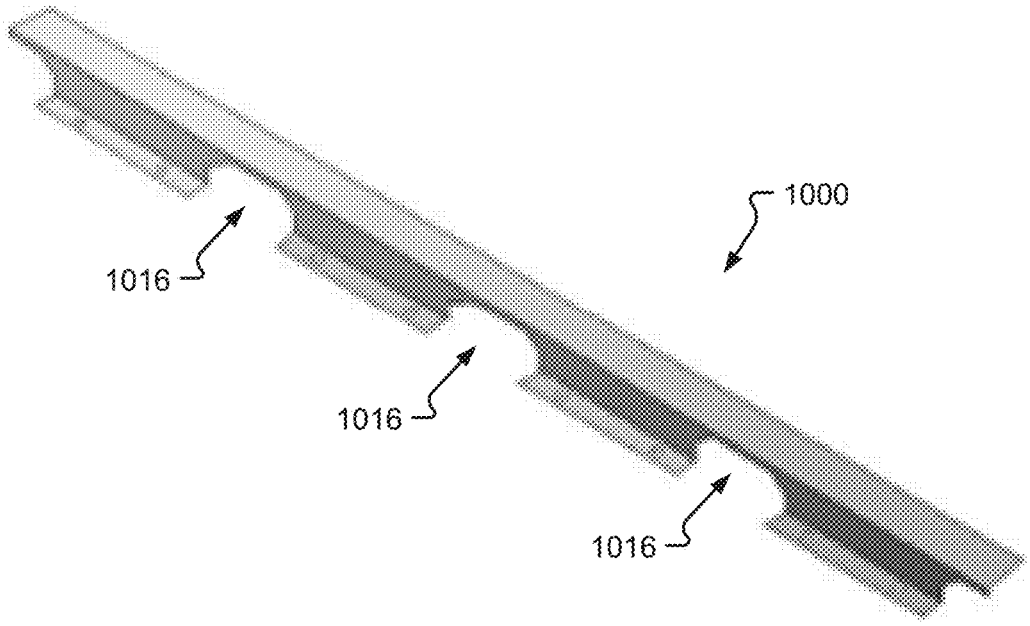
Fig. 10 (Prior Art)
FIG. 10 shows a prior art notched sub-purlin.
Figure 11:
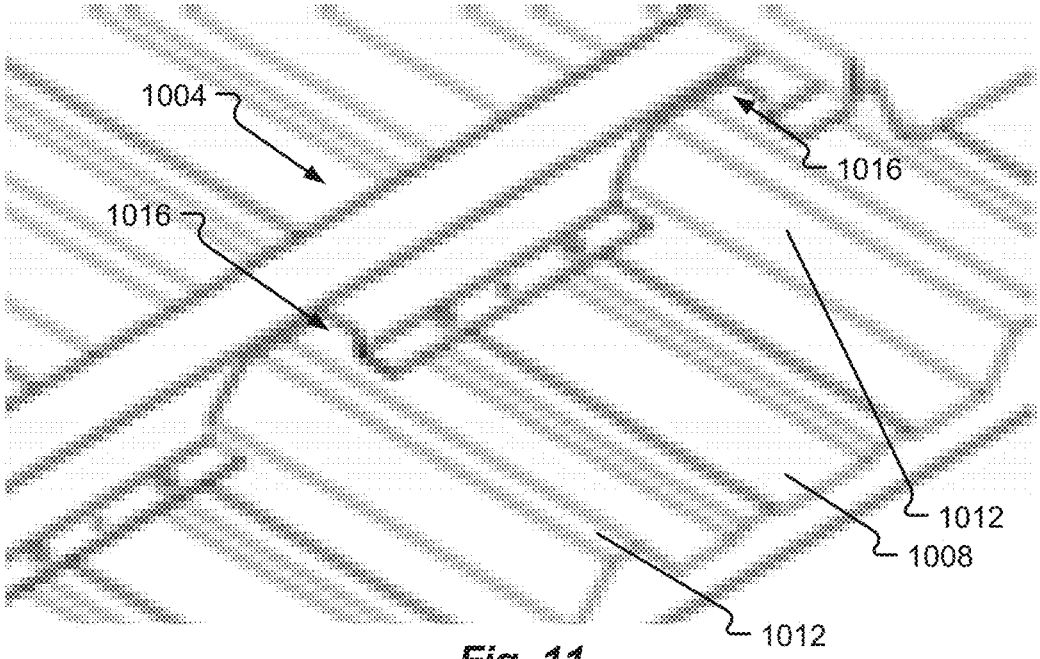
Fig. 11 (Prior Art)
FIG. 11 shows a prior art notched sub-purlin installed on a metal roof.

FIG. 9 shows a reinforced notched sub-purlin 200 comprising a top flange 104, a plurality of base flanges 108, a plurality of notches 116, a plurality of reinforcements 112, and a plurality of anti-rotational arms 220. Each of the top flange 104, the plurality of base flanges 108, the plurality of notches 116, and the plurality of reinforcements 112 may be the same as or similar to the corresponding components described above with respect to FIGS. 1-8.

The anti-rotational arms 220 shown in FIG. 9 extend from the vertical web(s) 106 into the notches 116. The anti-rotational arms 220 are configured to be bent during installation so as to extend substantially perpendicularly to the vertical web(s) 106, and along the length of a rib or other raised portion received by the corresponding notch 116. Each anti-rotational arm 220 may contact the side of the rib or other raised portion of the existing roof panel that is received into the notch 116. The anti-rotational arms 220 may be provided with one or more holes, through which one or more fasteners may extend so as to secure the anti-rotational arms 220 to the ribs or other raised portions adjacent thereto. In some embodiments, a combination of adhesive and mechanical fasteners may be utilized to secure each anti-rotational arm 220 to an adjacent rib. In still other embodiments, the anti-rotational arms 220 may be provided with short spikes or other surface treatment along a side that will contact an adjacent rib or other raised portion of an existing roof panel, which spikes or other surface treatment may help to prevent movement of the anti-rotational arm relative 220 relative to the rib or other raised portion.

The anti-rotational arms 220 may assist in fixing the reinforced notched sub-purlin 100 to an existing roof panel, to prevent movement of the reinforced notched sub-purlin 100 relative to the existing roof panel. Also, in some embodiments, the anti-rotational arms 220 may be the only points of attachment of the reinforced notched sub-purlin 100 to the rib or other raised portion of an existing roof panel. In other words, the anti-rotational arms 220 may be used instead of the base flanges 108 to secure the reinforced notched sub-purlin 100 to an underlying roof.

In FIG. 9, the anti-rotational arms 220 have a substantially trapezoidal shape with a plurality of holes therethrough. Some of the holes are slot holes and others are circular holes. Other embodiments may utilize anti-rotational arms 220 having a different shape and/or one or more holes to facilitate the placement of one or more fasteners therethrough. In some embodiments, for example, the anti-rotational arms 220 may be circular, rectangular, or any other shape. The size and shape of the anti-rotational arms 220 may be selected based on the size and shape of the ribs or other raised portions of a roof on which the reinforced notched sub-purlin will be installed, and/or based on one or more desired characteristics of the reinforced notched sub-purlin 100.

Although FIG. 9 shows an anti-rotational arm 220 in each notch 116, the number of anti-rotational arms 220 may not equal the number of notches 116. In some embodiments, for example, two anti-rotational arms 220 may extend into each notch 116 (one from each longitudinal side thereof), while in other embodiments, the anti-rotational arms 220 may be positioned to extend into every other notch.

Fasteners used to attach the anti-rotational arms 220 to a rib or other raised portion of an existing roof panel may be attached through the pre-created holes in the anti-rotational arms 220. However, not all holes may receive a fastener, and not all fasteners may be installed through the holes.

In the embodiment of FIG. 9, each vertical web 106 (or each portion of a vertical web 106 adjacent a notch 116) is provided with four reinforcements 112 along a length (in the longitudinal direction) thereof. Two central reinforcements 112 are slanted at an angle and extend from proximate the base flange 108 to proximate the top flange 104. To outer reinforcements 112 are slanted in opposite directions, each arranged substantially parallel to an edge of a proximate notch 116, and each containing a bend so that a portion of the reinforcement 112 extends substantially parallel and proximate to the top flange 104. In other embodiments according to the present disclosure, however, each vertical web 106 (or portion of a vertical web adjacent a notch 116) may comprise more or fewer reinforcements 112. Moreover, the reinforcements 112 may be arranged differently on the vertical web(s) 106 than the reinforcements 112 shown in FIG. 9.

As with the reinforcements 112 shown in FIGS. 1-8, the reinforcements 112 may be formed in the vertical web(s) 106 by stamping, pressing, or otherwise. In some embodiments, the reinforcements 112 may be made by pressing a mold into the vertical web(s) 106. The reinforcements 112 may increase the stiffness and/or strength of the reinforced notched sub-purlin 100, and may increase the resistance of the reinforced notched sub-purlin to deformation under stress and/or strain. The reinforcements 112 may further aid in the prevention of fractures, cracks, and/or breakage of the reinforced notched sub-purlins 100. The reinforcements 112 may significantly improve the ability of the vertical web 106 to resist forces resulting from uplift wind loads and downward snows loads.

Although the foregoing description has focused primarily on the use of reinforced notched sub-purlins in connection with installation of a new panel roof over an existing panel roof, reinforced notched sub-purlins according to embodiments of the present disclosure are equally well suited for use in connection with the installation of a new panel wall over an existing panel wall.

Reinforced notched sub-purlins according to embodiments of the present disclosure may be formed of metal, or a composite material, or any other material having suitable strength. In some embodiments, a reinforced notched sub-purlin according to embodiments of the present disclosure may be made from a single sheet of material, such as a single sheet of sheet metal. For example, a single sheet of sheet metal may be stamped, cut, pressed, and otherwise formed into a reinforced notched sub-purlin as shown in the accompanying drawings and as described above.

Embodiments of the present disclosure include a reinforced notched sub-purlin comprising: a top flange having a first longitudinal edge and a second longitudinal edge; a vertical web extending from the first longitudinal edge of the top flange; a plurality of base flanges extending from a side of the vertical web opposite a side of the vertical web that is proximate the first longitudinal edge; at least one notch separating two of the plurality of base flanges and extending to proximate the top flange; and at least one reinforcement on the vertical web and proximate the notch.

Aspects of the foregoing reinforced notched sub-purlin include: wherein the at least one reinforcement extends along an edge of the notch; wherein the at least one reinforcement comprises a plurality of reinforcements, with at least a first one of the plurality of reinforcements extending along an edge of the notch and at least a second one of the plurality of reinforcements positioned approximately midway between two notches; wherein the at least one reinforcement comprises a stamped portion of the vertical web; wherein the at least one reinforcement comprises a first straight portion separated from a second straight portion by a bend; wherein the at least one reinforcement and the top flange each extend from the vertical web in the same direction; wherein the vertical web extends substantially perpendicularly from the top flange; wherein the plurality of base flanges extend substantially perpendicularly from the vertical web; wherein the top flange and the plurality of base flanges are substantially parallel, and the vertical web is substantially perpendicular to the top flange and the plurality of base flanges; wherein the at least one notch comprises a plurality of notches, and the at least one reinforcement comprises at least three reinforcements between each adjacent pair of notches; wherein the second longitudinal edge of the top flange forms a lip; wherein each of the plurality of base flanges comprises at least one hole; further comprising an anti-rotational arm extending from the vertical web into the at least one notch; wherein the anti-rotational arm comprises at least one hole; wherein the anti-rotational arm has a substantially trapezoidal shape; wherein the top flange, the vertical web, the plurality of base flanges, and the at least one reinforcement are manufactured from a single sheet of material; wherein the material is metal; a plurality of notches and a plurality of reinforcements on the vertical web in between each notch; wherein the top flange has a greater width than each of the plurality of base flanges; and wherein the at least one notch has at least five edges, with each of the at least five edges positioned at a different angle than an adjacent edge.

A number of variations and modifications of the foregoing disclosure can be used. It would be possible to provide for some features of the disclosure without providing others.

Although the present disclosure describes components and functions implemented in the aspects, embodiments, and/or configurations with reference to particular standards and protocols, the aspects, embodiments, and/or configurations are not limited to such standards and protocols. Other similar standards and protocols not mentioned herein are in existence and are considered to be included in the present disclosure. Moreover, the standards and protocols mentioned herein and other similar standards and protocols not mentioned herein are periodically superseded by faster or more effective equivalents having essentially the same functions. Such replacement standards and protocols having the same functions are considered equivalents included in the present disclosure.

The present disclosure, in various aspects, embodiments, and/or configurations, includes components, methods, processes, systems and/or apparatus substantially as depicted and described herein, including various aspects, embodiments, configurations embodiments, sub-combinations, and/or subsets thereof. Those of skill in the art will understand how to make and use the disclosed aspects, embodiments, and/or configurations after understanding the present disclosure. The present disclosure, in various aspects, embodiments, and/or configurations, includes providing devices and processes in the absence of items not depicted and/or described herein or in various aspects, embodiments, and/or configurations hereof, including in the absence of such items as may have been used in previous devices or processes, e.g., for improving performance, achieving ease and/or reducing cost of implementation.

The foregoing discussion has been presented for purposes of illustration and description. The foregoing is not intended to limit the disclosure to the form or forms disclosed herein. In the foregoing Detailed Description, for example, various features of the disclosure are grouped together in one or more aspects, embodiments, and/or configurations for the purpose of streamlining the disclosure. The features of the aspects, embodiments, and/or configurations of the disclosure may be combined in alternate aspects, embodiments, and/or configurations other than those discussed above. This method of disclosure is not to be interpreted as reflecting an intention that the claims require more features than are expressly recited in each claim. Rather, as the following claims reflect, inventive aspects lie in less than all features of a single foregoing disclosed aspect, embodiment, and/or configuration. Thus, the following claims are hereby incorporated into this Detailed Description, with each claim standing on its own as a separate preferred embodiment of the disclosure.

Moreover, though the description has included description of one or more aspects, embodiments, and/or configurations and certain variations and modifications, other variations, combinations, and modifications are within the scope of the disclosure, e.g., as may be within the skill and knowledge of those in the art, after understanding the present disclosure. It is intended to obtain rights which include alternative aspects, embodiments, and/or configurations to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

We claim:

1. A reinforced notched sub-purlin comprising:

a top flange having a first longitudinal edge and a second longitudinal edge;

a vertical web extending from the first longitudinal edge of the top flange;

a plurality of base flanges extending from a first side of the vertical web opposite a second side of the vertical web that is proximate the first longitudinal edge;

a first notch separating a first base flange from a second base flange of the plurality of base flanges, the first notch extending into the vertical web to proximate the top flange; and a first reinforcement on the vertical web positioned proximate the first notch, the first reinforcement comprising a first linear portion and a second linear portion joined by a bent portion.

2. The reinforced notched sub-purlin of claim 1, wherein the first notch comprises a first linear edge and a second linear edge, and wherein:

the first linear portion of the first reinforcement extends along the first linear edge of the first notch; and the second linear portion of the first reinforcement extends along the second linear edge of the first notch.

3. The reinforced notched sub-purlin of claim 2, further comprising:

a second notch separating the second base flange from a third base flange, the second notch comprising a third linear edge and a fourth linear edge;

a second reinforcement on the vertical web positioned proximate the second notch, the second reinforcement comprising a third linear portion and a fourth linear portion joined by a bent portion, wherein:

the first and second reinforcements are positioned between the first and second notches;

the second reinforcement is spaced from and does not contact the first reinforcement;

the third linear portion of the second reinforcement extends along the third linear edge of the second notch; and the fourth linear portion of the second reinforcement extends along the fourth linear edge of the second notch.

4. The reinforced notched sub-purlin of claim 1, wherein the first reinforcement comprises a stamped portion of the vertical web.

5. The reinforced notched sub-purlin of claim 1, wherein the first reinforcement is formed separately and attached to the vertical web.

6. The reinforced notched sub-purlin of claim 1, wherein the first reinforcement and the top flange each extend from the vertical web in the same direction, and wherein the second linear portion of the first reinforcement extends approximately parallel to a plane defined by the top flange.

7. The reinforced notched sub-purlin of claim 3, further comprising a third reinforcement on the vertical web positioned between the first reinforcement and the second reinforcement, the third reinforcement oriented approximately orthogonal to the top flange and the second base flange.

8. The reinforced notched sub-purlin of claim 7, wherein the vertical web is planar between the second reinforcement and the third reinforcement such that the third reinforcement is spaced from and does not contact the first reinforcement.

9. The reinforced notched sub-purlin of claim 1, wherein the top flange and the plurality of base flanges are substantially parallel, and the vertical web is substantially perpendicular to the top flange and the plurality of base flanges, wherein the second longitudinal edge of the top flange forms a lip, and wherein each of the plurality of base flanges comprises at least one hole.

10. The reinforced notched sub-purlin of claim 1, wherein the first linear portion of the first reinforcement is oriented at an oblique angle relative to the second linear portion of the first reinforcement, wherein the first reinforcement has a first end associated with the first linear portion and positioned proximate to the first base flange, and wherein the first reinforcement has a second end opposite to the first end that is associated with the second linear portion and positioned proximate to the top flange.

11. The reinforced notched sub-purlin of claim 1, wherein the first notch comprises a first linear edge and a second linear edge, and wherein the first reinforcement is spaced from the first and second linear edges.

12. The reinforced notched sub-purlin of claim 2, wherein at least a portion of the second linear portion of the first reinforcement is positioned between the second linear edge of the first notch and the first longitudinal edge of the top flange.

13. A reinforced notched sub-purlin comprising:

a top flange defining a planar surface;

a vertical web extending from the top flange and substantially perpendicular to the planar surface;

a plurality of base flanges extending from a first side of the vertical web opposite a second side of the vertical web that is proximate the top flange;

a first notch between a first base flange and a second base flange of the plurality of base flanges, the first notch extending into the vertical web to proximate the top flange;

a first reinforcement on the vertical web and proximate the first notch, the first reinforcement comprising a first portion and a second portion, the first portion oriented at an oblique angle relative to the second portion; and an anti-rotational arm extending from the vertical web into the first notch.

14. The reinforced notched sub-purlin of claim 13, wherein the anti-rotational arm comprises at least one hole, and wherein the top flange has a greater width than of the plurality of base flanges.

15. The reinforced notched sub-purlin of claim 13, wherein:

the first notch comprises:

a first edge oriented at an oblique angle to the top flange; and a second edge oriented approximately parallel to the top flange;

the first portion of the first reinforcement extends along the first edge of the first notch; and the second portion of the first reinforcement is oriented approximately parallel to the top flange.

16. The reinforced notched sub-purlin of claim 13, wherein the top flange, the vertical web, the plurality of base flanges, and the first reinforcement are manufactured from a single sheet of a metal material.

17. The reinforced notched sub-purlin of claim 15, wherein at least a portion of the second portion of the first reinforcement is positioned between the first notch and the top flange, and wherein an end of the second portion is positioned between the first notch and the top flange.

18. The reinforced notched sub-purlin of claim 17, further comprising:

a second notch between the second base flange and a third base flange, the second notch comprising:

a third edge oriented at an oblique angle to the top flange; and a fourth edge oriented approximately parallel to the top flange;

a second reinforcement comprising:

a third portion that extends along the third edge of the second notch; and a fourth portion that is oriented approximately parallel to the top flange; and a third reinforcement between the first and second reinforcements, the third reinforcement oriented approximately perpendicular to the top flange.

19. The reinforced notched sub-purlin of claim 13, wherein the first reinforcement is spaced from the first notch.

20. A reinforced notched sub-purlin comprising:

a vertical web having a top edge and a bottom edge;

a top flange extending from the top edge perpendicular to the vertical web;

a first base flange, a second base flange, and a third base flange extending from the bottom edge of the vertical web;

a first notch separating the first base flange from the second base flange;

a second notch separating the second base flange from the third base flange, the first and second notches extending to proximate the top flange;

a first reinforcement on the vertical web that extends along two edges of the first notch, the first reinforcement spaced from the two edges of the first notch;

a second reinforcement on the vertical web that extends along two edges of the second notch, the second reinforcement spaced from the two edges of the second notch; and a third reinforcement on the vertical web positioned between the first and second reinforcements, wherein a first portion of the vertical web between the first and third reinforcements is generally planar, and wherein a second portion of the vertical web between the second and third reinforcements is generally planar.

* * * * *